United States Patent [19]

Pottier

[11] 4,181,894

[45] Jan. 1, 1980

[54] HEAVY ION ACCELERATING STRUCTURE AND ITS APPLICATION TO A HEAVY-ION LINEAR ACCELERATOR

[75] Inventor: Jacques Pottier, Orsay, France

[73] Assignee: Commissariat a l'Energie Atomique, Paris, France

[21] Appl. No.: 900,128

[22] Filed: Apr. 26, 1978

[30] Foreign Application Priority Data

May 5, 1977 [FR] France ..... 77 13700

[51] Int. Cl.[2] ..... H01J 23/18; H01J 25/02; H05H 7/00

[52] U.S. Cl. ..... 328/233; 313/360; 315/5.41; 315/5.49

[58] Field of Search ..... 315/5.41, 5.49; 328/233; 313/360

[56] References Cited

U.S. PATENT DOCUMENTS

| | | | |
|---|---|---|---|
| 3,012,170 | 12/1961 | Heil | 315/5.41 |
| 3,332,024 | 7/1967 | LeBoutet | 315/5.41 X |
| 3,341,720 | 9/1967 | Sowa | 328/233 X |

FOREIGN PATENT DOCUMENTS

| | | | |
|---|---|---|---|
| 871415 | 6/1961 | United Kingdom | 313/360 |

*Primary Examiner*—Palmer C. Demeo

*Attorney, Agent, or Firm*—Pearne, Gordon, Sessions, McCoy & Granger

[57] ABSTRACT

The accelerating structure comprises a resonant cavity within which are placed at least two longitudinal conducting supports. One end of each support is electrically connected to the cavity in such a manner as to be in quarter-wave resonance and in opposite phase. Drift tubes are electrically connected alternately to each of the two supports. The supports are electrically connected respectively to each end of the lateral face of the cavity.

8 Claims, 5 Drawing Figures

HEAVY ION ACCELERATING STRUCTURE AND ITS APPLICATION TO A HEAVY-ION LINEAR ACCELERATOR

This invention relates to a heavy-ion accelerating structure and, by way of application, to a heavy-ion linear accelerator.

Ion accelerators constituted by resonant structures which are provided with drift tubes and fed by a radio-frequency (rf) field are already known. Structures of this type are divided into accelerating zones and drift zones. The accelerating zones are constituted by gaps which are formed between the drift tubes and in which the electric field produces action on the ions at the correct phase in order to increase their velocity. The drift zones correspond to the space which is formed within said tubes and in which the ions are withdrawn from the field when this latter has a delaying action.

The transverse dimensions of these structures are of the order of a half-wavelength of the high-frequency wave when they vibrate in a mode of the E type (this is especially the case with the so-called Alvarez structures) and of a quarter-wavelength when they vibrate in a mode of the TE type. In actual fact, such structures are really suitable only for beams which have a fairly high energy of the order of a few MeV/A (Mega-electrons-volt per nucleon) and high frequency (radio-frequency), thus resulting in short wavelengths. In the case of much lower energies, especially those which exist in the ion injection zone, the wavelength is of higher value and the overall size then becomes prohibitive.

It is for this reason that structures of the shielded line or coaxial type are often employed at the input of an ion accelerator since these structures introduce special characteristics in the field distribution, thus making it possible to obtain resonances with transverse dimensions which are very much smaller than the wavelength.

The essential disadvantage of these structures lies in the fact that the longitudinal distribution of the accelerating voltage between drift tubes has approximately the shape of a sine-wave. The result thereby achieved is that, on the one hand, the mean accelerating voltage is of the order of only $2/\pi$ times the maximum voltage and that, on the other hand, since this distribution is in turn a function of the position-location of the drift tubes, the design study of such a structure is possible only by means of successive approximations.

It is for the above reason that the coaxial cable or line is supported from point to point by a short-circuited section having a length in the vicinity of $\lambda/4$, thus making it possible to impose conditions at each point with limits such that the voltage distribution comes close to a series of sine-wave arches. The disadvantage of this method lies in the fact that cumbersome lateral extensions are added to that portion of the cavity which is employed for ion acceleration. The greater part of the energy is thus dissipated within said extensions since current antinodes are found to be present at the short-circuited ends of these latter without thereby contributing to the ion acceleration process.

In order to overcome these disadvantages, accelerating structures formed by resonant cavities have also been proposed. Two longitudinal conducting supports are placed within the cavity and the ends of said supports are fixed respectively on the entrance face and on the exit face of the cavity, the two supports being thus in quarter-wave resonance and in opposite phase. The drift tubes are electrically connected alternately to each of the two supports.

These cavities give rise to difficulties in both construction and assembly since drift tubes are not readily accessible when they are mounted within the cavity by reason of the fact that this latter is so designed as to be closed by its two end faces.

The invention is precisely directed to a cavity of this type in which this drawback is removed. To this end, the longitudinal conducting supports are no longer joined to the end faces but are joined instead to the side wall of the cavity.

In more precise terms, the present invention has for its object an accelerating structure of the type comprising a resonant cavity within which are placed at least two longitudinal conducting supports, one end of each support being electrically connected to the cavity in such a manner as to be in quarter-wave resonance and in opposite phase, drift tubes being electrically connected alternately to each of the two supports, wherein said supports are electrically connected respectively to each end of the lateral face of the cavity.

In a first alternative embodiment, the cavity comprises only two supports disposed symmetrically with respect to the axis of said cavity.

In a second alternative embodiment which is more complex but results in enhanced rigidity, the cavity is provided with two pairs of supports, the supports of either pair being disposed symmetrically with respect to the axis of the cavity, each drift tube being connected to the two supports of either pair.

In each alternative embodiment, the supports can be either mounted in overhung position or joined to the side wall by means of an insulator.

In addition to the advantage conferred from the point of view of assembly, a structure of this type further permits of association of a plurality of structures placed in end-to-end relation. Furthermore, the compact character of the structure facilitates the construction of superconducting accelerating cells.

The structure in accordance with the invention also lends itself to the construction of a variable-energy ion accelerator. It is known in this connection that the energy of the ions delivered by a particle accelerator is dependent on the geometry of the accelerator and on the characteristics of the accelerating field (frequency and intensity). Different methods have accordingly been proposed for obtaining variable energy:

- by regulating the operating frequency, but this results in a high degree of complexity of the installation;
- by modifying the geometry of the structure, but this entails the need for interruptions of accelerator operation over long periods of time;
- by dividing the accelerator or at least part of this latter into a fairly large number of elementary sections each having a single accelerating gap (this solution having been adopted in the case of the Unilac at Darmstadt) or a single drift tube (in accordance with the design proposed at Heidelberg) in which both the field and the phase can be adjusted individually. The method just mentioned has the effect of introducing a considerable complication in the constructional design of the accelerator, impairs the energy gain and consequently increases the radio-frequency power supply.

The accelerator in accordance with the invention overcomes the disadvantages mentioned in the foregoing by virtue of the accelerating structure employed. To this end, the accelerator is composed of a small number of sections arranged as follows: if consideration is given to the $n^{th}$ section, the $n-1$ first sections accelerate the particles to a velocity $v_{n-1}$. The $n^{th}$ section is so designed as to accelerate the synchronous particle from the velocity $v_{n-1}$ to a higher velocity $v_n$. However, this section is sufficienly short to ensure that a particle can be accelerated, subject to a reduction in the rf field and a suitable phase adjustment of said field in accordance with a non-synchronous process at a velocity v' within the range of $v_{n-1}$ to $v_n$. This particle leads with respect to the synchronous particle at the entrance of the section considered and lags thereafter. By way of example, a structure having a length limited to approximately ten $\beta\lambda$ at a maximum (where $\beta=v/c$ is the ratio of the velocity of the particle to the velocity of light and $\lambda$ is the wavelength within the vacuum of the accelerating field) is capable of accelerating particles at variable energy in a very simple manner between the value $W_n$ and the value $2W_n$, where $W_n$ is the energy per nucleon obtained.

An ion accelerator as thus constituted is of very straightforward and economical construction since it comprises a small number of accelerating sections, each section being of simple construction since it operates at fixed frequency. Moreover, the energy gain of these sections (as determined by the shunt-impedance value) is much better than in the case of cavities in which provision is made for a single drift tube or a single accelerating gap.

In consequence, the invention is further directed to the application of the accelerating structure defined in the foregoing to the construction of a heavy-ion accelerator and especially a variable-energy accelerator in which the last accelerating structure in operation is fed by a radio-frequency field of variable amplitude and phase. The distinctive features and advantages of the invention will in any case be brought out by the following description of exemplified embodiments which are given by way of explanation and not in any sense by way of limitation, reference being made to the accompanying drawings, wherein:

Figure 5:
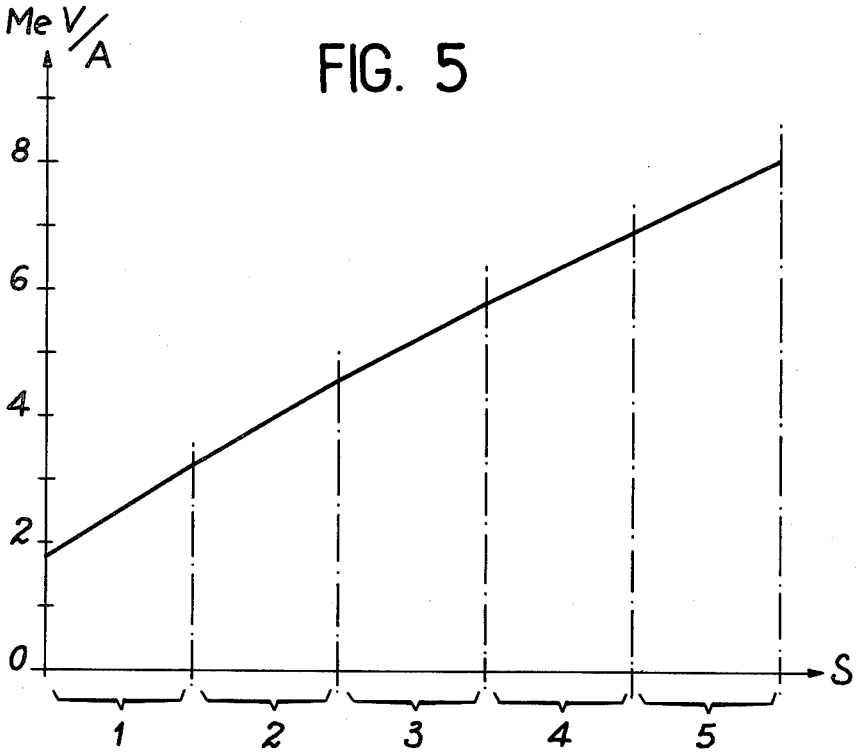

-FIG. 5 is a plot of a curve showing the progressive variation in ion energy at the exit of the five accelerating sections of a structure after pre-acceleration within sections in accordance with the invention. In the longitudinal sectional view of FIG. 1, the structure which is illustrated comprises a resonant cavity 14 within which are mounted two longitudinal conducting supports 16 and 18. One end of the support 16 is connected electrially and mechanically to the end 20 of the side wall of the cavity and the support 18 is connected to the opposite end 22. The other ends 24 and 26 respectively of the supports are not connected electrically to the cavity but can be connected mechanically to this latter if necessary. The drift tubes 28 and 30 are electrically and mechanically connected alternately to the two supports 16 and 18. In other words, the tubes 28 are connected to the support 16 and the tubes 30 are connected to the support 18.

Under these conditions, the supports 16 and 18 are at quarter-wave resonance and in opposite phase with respect to each other. The voltage between the drift tubes varies relatively little from one gap to the other: said voltage has a maximum value at the center of the cavity and a minimum value at each end which is lower by approximately 30%.

The points of attachment of the supports to the side wall can be located at a distance from the ends of the wall which is of the order of a fraction of the operating wavelength and lower than $\lambda/5$, for example.

As a result of attachment of the supports at the two opposite ends of the cavity wall, the current I which passes through one support is progressively shunted towards the other support through the capacitances which are constituted by the drift tubes. Under these conditions, the magnetic field B is essentially transverse within the cavity. As a first approximation, said cavity behaves as a self-inductance associated with a capacitance derived from the longitudinal conductors and the drift tubes, the assembly being thus intended to constitute a resonant circuit.

This arrangement endows the structure with a high value of inductance and therefore a relatively low resonant frequency in spite of the small transverse dimensions and is conducive to a relatively uniform current distribution, thus giving rise to moderate radio-frequency losses and therefore to an acceptable shunt impedance.

Figure 1:
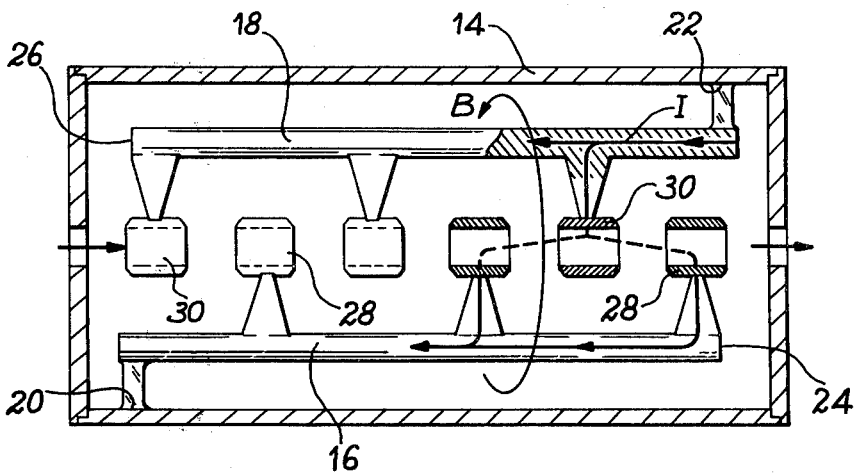
-FIG. 1 is a diagrammatic sectional view of the structure in accordance with the invention, in the first alternative embodiment in which provision is made for two supports.
Figure 2:
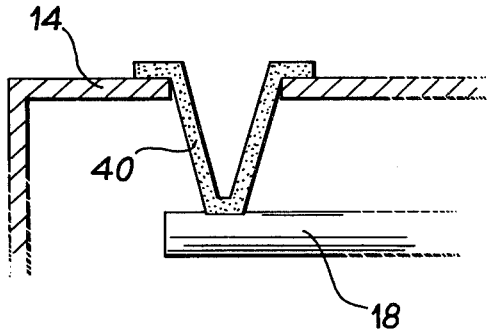
-FIG. 2 is a diagrammatic view of the means for joining the end of a support to the side wall.

The supports of the drift tubes can be mounted in overhung position as is the case with the structure shown in FIG. 1 but can also be held at their free ends as shown in FIG. 2. An insulator 40 bears on the external wall 14 of the casing and holds the support 18 in position. The insulator shown is of hollow construction and may be air-cooled if necessary.

Figure 3:
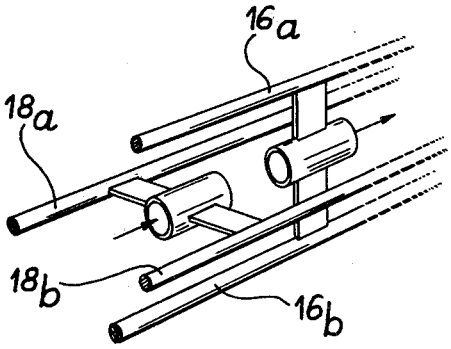
-FIG. 3 illustrates a second alternative embodiment in which the cavity comprises two pairs of supports.

In accordance with a second alternative embodiment, the cavity is provided with two pairs of supports instead of only one as illustrated in FIG. 3. The first pair of supports is constituted by the conductors **16*a* and 16*b* and the second pair is constituted by the conductors 18*a* and 18*b***. The second conductors are preferably located in a plane at right angles to the plane of the first conductors. The drift tubes are connected alternately to either of these pairs in order to constitute a cruciform structure having enhanced rigidity.

Figure 4:
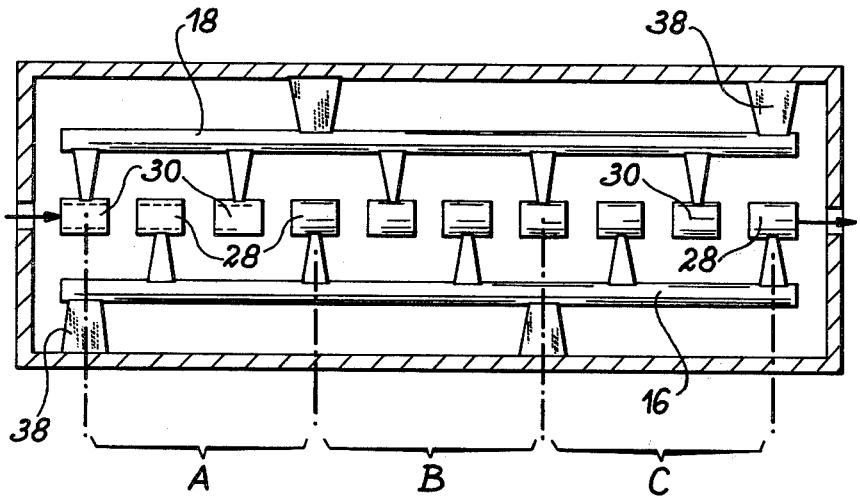
-FIG. 4 is a diagrammatic longitudinal sectional view showing an assembly of three accelerating structures in accordance with the invention which are mounted in end-to-end relation.

The design concept of the accelerating structure in accordance with the invention is well suited to the end-to-end association of a plurality of sections as illustrated in FIG. 4. In this figure which is a longitudinal sectional view, three accelerating cells A, B, C are shown and each comprise two supports 16 and 18 to which drift tubes 28 and 30 respectively are connected.

It can be indicated by way of explanation without any limitation being implied that a cavity in accordance with the invention and resonant at 100 MHZ has a diameter of approximately 20 cm and a length in the vicinity of 50 cm. The cavity characteristics are well suited to the design of a superconducting cavity which results in a more rigid construction than the helices which are usually employed and the acceleration produced per accelerating section of said cavity is higher than the split rings which are also in use.

In the case of a cavity which is resonant in the vicinity of 25 MHZ, the approximate length is 2 m in respect of a diameter of 50 cm. Under these conditions and in the case of particles of 250 keV/A energy, the shunt impedance is within the range of 50 to 100 MΩ/A, depending on the diameter of the drift tubes.

A variable-energy heavy-ion linear accelerator will now be described by way of application. This accelerator comprises a pre-accelerator and a variable-energy accelerating section.

At the input end of the pre-accelerator, the ions having a ratio q/A of the number of electronic charges carried by said ions to their mass number which can be as low as 0.046, for example, are injected by means of an electrostatic injector with an energy which can be as low as 12 keV/A into a first accelerating section after having passed through a buncher.

The low ion velocity gives rise to two consequences:

-the need to employ a relatively long wavelength in this section such as 12 m, for example, which corresponds to a frequency of 25 MHz, -the difficulty involved in maintaining the beam in the focused state, thus making it necessary to have recourse to internal focusing.

In order to facilitate this requirement, said first section is constituted by a conventional coaxial cable or line which vibrates at a quarter-wave frequency. The accelerating field which is of minimum value at the input at which the focusing difficulties are most pronounced will then increase in magnitude.

At the exit end of this section which has a length in the vicinity of 1.5 m, the energy attained is approximately 50 keV/A. It is again necessary to employ internal focusing but the field can be substantially constant. This portion 8 m in length which again operates at 25 MHz is usefully designed in the form of compact structures and brings the ion energy to the vicinity of 0.4 MeV/A. Said ions can then be subjected to "peeling" which brings their ratio q/A to the vicinity of 0.12. Their velocity is then sufficient to permit acceleration by a field having a frequency of 50 MHz. It is then no longer necessary to have recourse to internal focusing: the machine can be divided into sections of compact structure having a wavelength of the order of a few meters (three meters, for example) which do not entail the need for internally focusing since the optical focusing systems are external.

A total wavelength in the vicinity of 12 m in the case of said second section serves to bring the ions to an energy of approximately 1.8 MeV/A.

After they have been subjected to peeling which brings their ratio q/A to at least 0.21, the ions can be injected into the so-called variable-energy accelerator proper. This latter consists of a series of accelerating structures such as five structures, for example, if it is desired to attain an energy in the vicinity of 8 MeV/A.

The structures of the accelerator proper can be either of known type or of the compact type described earlier, especially if superconductivity is employed. In the example described, said structures are of known type.

The length of the compact structures must be:

(1) sufficiently long to lead to an economical and reliable solution and to avoid an unnecessarily large number of sections;

(2) sufficiently short to avoid the need for internal focusing, thus facilitating the construction of the accelerator and making it possible to increase the shunt impedance to a large extent as a result of the decrease in diameter of the drift tubes (a few centimeters) which is thus made possible;

(3) sufficiently short to be compatible with good relative energy resolution (higher than $10^{-3}$ for example), energy adjustment being obtained by adjustment of the radio frequency field intensity combined with phase adjustment in the last cavity employed.

The length aforesaid can be approximately 3 meters, for example, if the operation is performed at a frequency of 100 MHz.

FIG. 5 shows the ion energy evolution (in the case of $^{40}Ca$) expressed in MeV/A at the exit of the different sections plotted as abscissae according to their order.

What we claim is:

1. An ion accelerating structure comprising a cavity having a lateral wall, an entrance face, an exit face, and an axis, said cavity being resonant at an operating wavelength, said cavity containing a first pair of longitudinal conducting supports electrically connected on said lateral wall only at a point located near said entrance face for one support and near said exit face for the other support at a distance from said faces which is less than one fifth of said operating wavelength, said supports being each in quarter-wave resonance and in opposite phase relative to each other, and drift tubes electrically connected alternately to each of said supports.

2. A structure according to claim 1, wherein said supports are disposed symmetrically with respect to the axis of the cavity.

3. A structure according to claim 1, including a second pair of supports, the supports of either pair being disposed symmetrically with respect to the axis of the cavity, each drift tube being connected to the supports of either pair.

4. A structure according to claims 1, 2 or 3, wherein the supports are mounted in overhung position.

5. A structure according to claims 1, 2 or 3, wherein the supports are joined to the lateral wall of the cavity by means of an insulator placed at the electrically free ends of said supports.

6. A heavy-ion accelerating structure, wherein said heavy-ion accelerating structure is composed of a plurality of said ion accelerating structures according to claims 1, 2, or 3, said ion accelerating structures being placed in end-to-end relation.

7. A structure according to claims 1, 2, or 3, wherein said structure is utilized in a heavy-ion linear accelerator.

8. A heavy-ion linear accelerator according to claim 7, wherein at least one of said ion accelerating structures is fed by a radio-frequency field of variable amplitude and phase.

* * * * *